United States Patent [19]

Leonard et al.

[11] 4,267,705

[45] May 19, 1981

[54] REFRIGERATION PURGING SYSTEM

[75] Inventors: Gary S. Leonard, Minoa; Thomas M. Zinsmeyer, Pennellville, both of N.Y.

[73] Assignee: Carrier Corporation, Syracuse, N.Y.

[21] Appl. No.: 74,693

[22] Filed: Sep. 12, 1979

[51] Int. Cl.[3] ..... F25B 43/04

[52] U.S. Cl. ..... 62/195; 62/475

[58] Field of Search ..... 62/85, 195, 475

[56] References Cited

U.S. PATENT DOCUMENTS

| | | | |
|---|---|---|---|
| 2,450,707 | 10/1948 | Zwickl | 62/85 |
| 3,620,038 | 11/1971 | Muench | 62/195 |
| 3,710,585 | 1/1973 | Dillenbeck et al. | 62/85 |

*Primary Examiner*—Ronald C. Capossela

*Attorney, Agent, or Firm*—J. Raymond Curtin; Donald F. Daley

[57] ABSTRACT

A purge system for use in a refrigeration system utilizing more than one condenser, each of which operates at different pressures. The purge system includes a purge chamber having a cooling coil connected to the evaporator and adapted to condense refrigerant vapor. The purge chamber is connected to a main purge refrigerant line which includes a pressure reducing device. Either condenser in the refrigeration system is provided with a secondary purge refrigerant line connected to the main purge refrigerant line and having a one-way valve to prevent refrigerant flow from one condenser to another condenser. A pump is mounted in the system to remove the non-condensibles from the purge system. The pump is operatively connected to a pressure switch arranged between two sampling pressure lines, one of which is extending to the purge chamber and another one is extending to the main purge refrigerant line at a point ahead of the pressure reducing device. The pump is actuated when the pressure differential between the purge chamber and the main purge refrigerant line drops below a preset amount.

2 Claims, 1 Drawing Figure

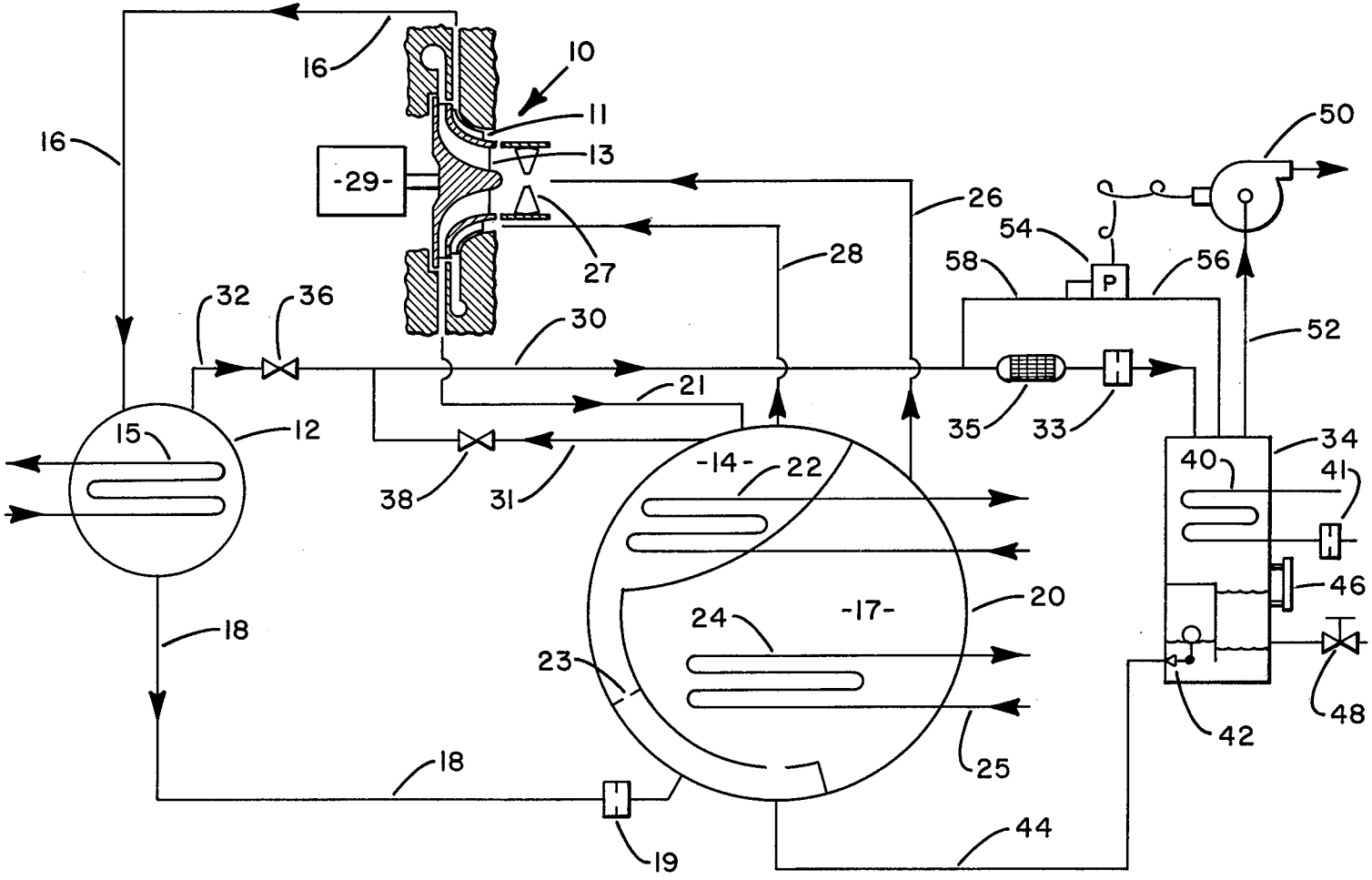
10
11
13
27
16
-29-
30
21
28
26
36
32
12
15
16
31
38
18
18
19
23
-14-
22
24
-17-
20
25
44
58
54
P
56
35
33
52
50
34
40
41
46
48
42

REFRIGERATION PURGING SYSTEM

BACKGROUND OF THE INVENTION

1. Field of the Invention

This invention relates to refrigeration purging systems used for the removal of air and other non-condensible gases from a refrigeration system and particularly the purging apparatus used in refrigeration systems employing two or more condensers.

2. Description of the Prior Art

In air conditioning large buildings, and in other applications, it is often necessary to provide both cooling and heating simultaneously. For example, the outer portion of the building will require heating in cold weather to compensate for heat loss through walls and windows; while the inner portion or core of the building will require cooling to compensate for the heat buildup in the center or unexposed portions of the building. During warm weather the heating requirement will diminish and the entire building may require cooling. In order to provide both heating and cooling, refrigeration systems have been developed which utilize a conventional compressor, condenser, evaporator system to promote cooling and which employ a second or high pressure condenser to provide heating. The heating condenser receives hot refrigerant vapor from the second, or higher, stage of a multiple stage compressor. The hot vapor is condensed in the heating condenser, heating water or other suitable medium to a temperature sufficient for use in heating the building.

In refrigeration systems the accumulation of non-condensible gases and other contaminants within the system reduce the efficiency of the system and must be periodically removed. To this end purge systems are utilized which normally use a chamber which accumulates non-condensibles by taking samples of the refrigerant from the top of the condenser, condensing the refrigerant and leaving the non-condensible to collect in the chamber. The chamber is cleared to atmosphere when the pressure in the chamber is nearly the same as the pressure in the condenser. However, with the utilization of two condensers at different pressures, which may or may not be operating at a given time, it is necessary to select one condenser, usually the one with the highest pressure for both sampling of the refrigerant and clearing of the chamber.

SUMMARY OF THE INVENTION

It is therefore an object of this invention to purge refrigeration systems having two or more condensers.

It is a further object of this invention to improve refrigeration purging equipment to permit purging of systems having multiple condensers operating at different pressures.

These and other objects of this invention are attained by a purging chamber having a main sampling line connected to each condenser in a refrigeration system. A one-way valve is associated with each condenser to allow a sample of refrigerant and non-condensibles to pass to the purging chamber from the condenser operating at the highest pressure and to prevent refrigerant from flowing from the condenser at higher pressure to the condenser at lower pressure. A differential switch is used to operate a pump which exhausts the purging chamber to atmosphere when the pressure in the purging chamber approaches the pressure in the main sampling line.

BRIEF DESCRIPTION OF THE DRAWINGS

The drawing is a schematic representation of a refrigeration system embodying the present invention.

DESCRIPTION OF THE PREFERRED EMBODIMENT

Referring to the drawing, the compressor 10 illustrated in the diagram is of the two-stage centrifugal type. A high pressure impeller 11 pumps refrigerant to a high pressure condenser 12 through line 16. A low pressure impeller 13 pumps refrigerant to a low pressure condenser 14 through line 21. An electric motor 29 or other suitable power source, such as a steam turbine, is coupled to the centrifugal compressor and drives the compressor impellers within the compressor casing. The high pressure, high temperature refrigerant vapor in the high pressure or heating condenser 12 heats tube bundle 15. Water is circulated through tube bundle 15 to remote heating units (not shown). Condensed liquid refrigerant is returned from condenser 12 to the cooler or evaporator 17 through piping 18 and orifice 19.

The low pressure condenser 14 and the cooler or evaporator 17 are within a single enclosure or unishell 20. The condensing portion of the unishell receives refrigerant flow from the low pressure impeller 13 through piping 21. A cooling medium is circulated through tube bundles 22 located within the low pressure condenser. The tube bundle 22 is in heat exchange relation with the refrigerant vapor and cools and condenses the refrigerant.

The condensed refrigerant in the low pressure condenser 14 flows through an orifice 23 and into the cooler 17. The cooler, as shown, is contained within the bottom portion of the unishell 20, and contains tube bundle 24. A cooling medium, usually water, is circulated through piping 25 into the tube bundles, where it is cooled and returned to the air conditioning system (not shown). Vaporized refrigerant within the cooler 17 is drawn off into the low pressure stage of compressor 10 through line 26 and guide vanes 27. The refrigerant leaving low pressure stage of compressor 10 passes to the condenser 14 through line 21 and a portion is then drawn from the condenser to the inlet of the high pressure stage through line 28.

Within the refrigeration system various non-condensible gases, such as air and contaminants, such as water, become mixed with the refrigerant and tend to collect at the top of the condensers. The buildup of non-condensibles and contaminants reduces the efficiency and capacity of the system.

In order to remove or purge the non-condensibles and contaminants from the system without also losing refrigerant, it is necessary to separate the non-condensibles and contaminants from the refrigerant. For this purpose a condensing purge chamber 34 is provided having a cooling coil 40 located therein. Coil 40 is connected to the cooler 17 (the connection line is not shown) to provide cold liquid refrigerant to the purge chamber coil. An orifice 41 is arranged in the connection line to reduce the refrigerant pressure. Cold refrigerant is circulated through the coil 40 to drop the temperatures of the vaporous mixture of refrigerant, non-condensible gases and contaminants. The condensed refrigerant condenser together with condensed water vapor collects at the bottom of the chamber while the non-condensible gases collect at the top of the chamber.

In order to extract the non-condensible gases from the condensers, a main sampling line 30 is provided between the purge chamber 34 and the vicinity of the two condensers 12 and 14. A low pressure sampling line 31 connects the low pressure condenser 14 to the main sampling line 30 and a high pressure sampling line 32 connects the high pressure condenser 12 to the main sampling line 30. An orifice 33 in the main sampling line 30 produces a pressure drop between the two condensers and the purge chamber 34.

A strainer 35 in the main sampling line 30 ahead of the orifice 33 filters out any extraneous solid particles entrained in the vapor and protects the orifice 33 from obstructions. The cooling coil 40 in the purge chamber has cold liquid refrigerant at the temperature of the cooler 17 flowing therethrough and condenses the vaporized refrigerant in the chamber producing a pressure in the chamber lower than the pressure in either condenser, thus providing continuous flow of vapor from the condensers to the purge unit. When the refrigeration system is operating with only a cooling load and no heating load, the pressure in the cooling or low pressure condenser 14 is higher than the pressure in the heating or high pressure condenser 12 and the refrigerant flow to the condenser 14 from the compressor 10 is considerably larger than the refrigerant flow to the heating condenser 12. The non-condensibles tend to collect in the condenser 14. As refrigerant condenses in the condenser, the non-condensibles collect in the vapor space. No refrigeration condenses in condenser 12 when there is no heating local therefore, non-condensibles flow through the condenser and do not accumulate therein. Since the condenser 14 is at a higher pressure than condenser 12, the refrigerant flows from the condenser 14 through the low pressure sampling line 31 and main sampling line 30 to the purge chamber 34. To prevent refrigerant flowing from condenser 14 to condenser 12 through sampling line 32, a one-way valve 36 is located in high pressure sampling line 32. When the refrigeration system is operating under demand for both heating and cooling, the pressure in the heating or high pressure condenser 12 is higher than the pressure in the cooling condenser 14 and the non-condensibles tend to collect in the heating condenser 12. Under these operating conditions, the higher pressure in condenser 12 feeds vapor to the purge chamber 34 through high pressure sampling line 32 and main sampling line 30. A one-way valve 38 in low pressure sampling line 31 prevents the higher pressure vapor from condenser 12 from flowing into the condenser 14. Thus, the combination of one-way valves 36 and 38 in the high pressure and low pressure sampling lines insures that the condenser operating under the higher pressure will supply refrigerant to the purge unit and that refrigerant vapor will not flow from either condenser to the other condenser.

As refrigerant vapor flows into purge chamber 34 from the main sampling line 30, the refrigerant condensate collects at the bottom of the chamber. When a predetermined quantity of refrigerant collects in the chamber, a float valve 42 or other suitable device automatically opens a valve allowing the refrigerant liquid to drain to the cooler 17 through line 44. Water vapor in the vaporous mixture also condenses and falls to the bottom of the chamber. Since the water is lighter than the refrigerant, it settles on top of the refrigerant liquid. A sight glass 46 is provided to determine when a quantity of water has accumulated and a manual valve 48 is also provided to drain off the accumulated water. The non-condensible gases remaining in the chamber accumulate at the top of the chamber and can be discharged to atmosphere by pump 50 through line 52. The pump 50 is operated automatically by a pressure differential switch 54. The switch 54 has contacts which are closed when the pressure in the purge chamber 34, as measured by a first pressure sampling line 56 from the switch to the purge chamber, approaches the pressure in the main sampling line 30, ahead of the orifice 33 as measured by a second pressure sampling line 58 extending between the switch and the main sampling line ahead of the orifice 33. The pressure differential switch 54 can be set to operate at any given pressure differential between the purge chamber and the main sampling line, for example, 2 p.s.i. As non-condensible gases buildup in the puge chamber, there is less refrigerant vapor being condensed and less pressure drop in the chamber. When the non-condensibles have accumulated to the point where the purge chamber pressure cannot be reduced below the pressure required to hold the pressure differential switch open, the switch contacts close activating pump 50 and expel the non-condensibles in the chamber to atmosphere. As the pressure in the chamber drops, the contacts open, deactivating the pump 50 and the purge unit continues to operate to eliminate non-condensibles from the system.

In conventional refrigeration systems which utilize one condenser, the purge unit is normally activated to expel non-condensibles by a pressure differential switch measuring the pressure differential between the purge chamber and the condenser. With the use of two or more condensers, this system is not practical since one or more of the condensers may not be operating or all of the condensers may be operating at different pressures. In addition, under a multiple condenser system, the pressure in the purge unit will vary depending on which chamber is actively supplying refrigerant vapor to the purge chamber.

Under the present system the purge unit is allowed to function under the pressure created by the condenser which is actively supplying refrigerant. For example, when the high pressure condenser 12 is supplying refrigerant, the pressure in the chamber 34 is higher than the pressure in the chamber when condenser 14 is actively supplying refrigerant vapor. The pressure differential switch 54 is sensitive only to pressure differential not the absolute pressure in the chamber 34 or main sampling line 30. The combination of the two check valves in the high pressure and low pressure sampling lines and the pressure differential switch which operates the pump 50 and which is responsive to pressure differential between the purge chamber and the main sampling line, produces a unique system which automatically allows a vaporous mixture of refrigerant and contaminants to be drawn from the appropriate condenser and non-condensibles to be expelled to atmosphere at a given time depending on which condenser is providing the refrigerant flow.

While the preferred embodiment of the invention has been described herein, it is to be understood that the invention is not limited to this precise system in form of apparatus and that changes may be made without departing from the scope of the invention.

What is claimed is:

1. A purge system for use in removing non-condensible gases and other contaminants, such as water, from a refrigeration system of the type utilizing more than one condenser, each of which operates at a different pressure, comprising:

a purge chamber having a cooling coil located in the chamber to condense refrigerant vapor, means to return condensed refrigerant to the refrigeration system and means to remove condensed contaminants from the chamber, a main purge line connected to the purge chamber to conduct refrigerant vapor, non-condensible gases and contaminants and including a pressure reducing device located in the line, a series of secondary purge refrigerant lines arranged to connect said main purge refrigerant line to each condenser to provide vaporous mixture from the condenser to the main purge refrigerant line, means located in each secondary purge refrigerant line to prevent vapor from flowing from one condenser to another condenser, pump means connected to the purge chamber to remove non-condensible gases from the purge chamber, a pressure differential measuring device connected by a first pressure sampling line to the purge chamber and by a second pressure sampling line to the main purge refrigerant line at a point ahead of the pressure reducing device, said pressure differential means being operatively connected to the pump means to activate the pump means when the pressure differential between the purge chamber and the main purge refrigerant line drops below a preset amount.

2. A purge system for use in removing non-condensible gases and other contaminants such as water from a refrigeration system of the type utilizing more than one condenser, each of which operate at different pressures, comprising:

a purge chamber including a cooling coil located in the chamber to condense refrigerant vapor, means to return condensed refrigerant to the refrigeration system, and means to remove condensed contaminants from the chamber, a main sampling line connected to the purge chamber to provide a vaporous mixture of refrigerant, non-condensibles and the contaminants to the purge chamber and having a pressure reducing device located in the line, a series of secondary sampling lines connected to the main sampling line and to each condenser to provide the vaporous mixture to the main sampling line from the condensers and having a one-way valve located in each line to prevent vapor from flowing from one condenser to another condenser, pump means connected to the purge chamber to expel non-condensible gases from the purge chamber and, a pressure differential means having a pressure switch and two pressure sampling lines extending from the pressure switch to the purge chamber and to the main sampling line at a point ahead of the pressure reducing device, said pressure switch being operatively connected to the pump means to activate the pump means when the pressure differential between the purge chamber and the main sampling line drops below a preset amount.

* * * * *